US007581413B2

(12) United States Patent
Tsai

(10) Patent No.: US 7,581,413 B2
(45) Date of Patent: Sep. 1, 2009

(54) CONVENIENT WASHING MACHINE STRUCTURE

(76) Inventor: Mao-Bang Tsai, 3F-3, No. 107, ChungCheng Street, Taichung City (TW)

( * ) Notice: Subject to any disclaimer, the term of this patent is extended or adjusted under 35 U.S.C. 154(b) by 500 days.

(21) Appl. No.: 11/453,891

(22) Filed: Jun. 16, 2006

(65) Prior Publication Data

US 2007/0289340 A1 Dec. 20, 2007

(51) Int. Cl.
*D06F 37/04* (2006.01)

(52) U.S. Cl. ..... 68/58; 68/140

(58) Field of Classification Search ..... 68/139, 68/140

See application file for complete search history.

(56) References Cited

U.S. PATENT DOCUMENTS 1,948,879 A * 2/1934 Green ..... 68/208
2,019,571 A * 11/1935 Kirby ..... 68/25
2,255,028 A * 9/1941 Long ..... 68/12.19
2,520,685 A * 8/1950 Horvath ..... 68/21
2,861,446 A * 11/1958 Holger et al. ..... 68/4

* cited by examiner

*Primary Examiner*—Frankie L Stinson
(74) *Attorney, Agent, or Firm*—Rabin & Berdo, P.C.

(57) ABSTRACT

A portable compact washing machine that comprises a base, a drum, a motor housing, a motor and a decelerator. The drum is mounted rotatably in the base. The motor housing is mounted in the base and aligns with the drum. The motor is mounted in the motor housing and connects directly to the drum through the decelerator that stabilizes power transmitted to the drum and higher power transmission efficiency and a better cleaning effect.

2 Claims, 4 Drawing Sheets

CONVENIENT WASHING MACHINE STRUCTURE

FIELD OF THE INVENTION

This application relates to a washing machine, and more particularly to a portable compact washing machine that operates efficiently and has a good cleaning effect.

BACKGROUND OF THE INVENTION

Conventional portable washing machines are driven manually or with a complex rotating mechanism and comprise a base, a rotating shaft, a drum and a rotating mechanism.

The base comprises a mounting structure. The rotating shaft is mounted rotatably on the base. The drum is mounted on the rotating shaft and rotates on the base. The rotating mechanism connects to the rotating shaft or the drum and may be a linkage connected to a manual crank or a motor to rotate the drum and wash clothing or linens inside by agitating, rinsing and spin drying clothing or linens in the drum with detergent and water.

However, conventional portable washing machines have numerous disadvantages including inconsistent operation for manually driven machines and structural complexity for motor driven machines. Specifically, manual operation is difficult and requires a significant amount of strength and time, and causes the drum to rotate at inconsistent speeds of the rolling drum, which results in incomplete washing and rinsing. Further, motor driven portable washing machines tend to be overly complex and use drive belts or complex drive gears.

SUMMARY OF THE INVENTION

An objective of the invention is to provide a simplified portable compact washing machine with better power transmission efficiency and a better cleaning effect.

A portable compact washing machine in accordance with the present invention comprises base, a drum, a motor housing, a motor and a decelerator. The drum is mounted rotatably in the base. The motor housing is mounted in the base and aligns with the drum. The motor is mounted in the motor housing and connects directly to the drum through the decelerator that stabilizes power transmitted to the drum and provides higher power transmission efficiency and a better cleaning effect.

DETAILED DESCRIPTION OF THE INVENTION

Figure 1:
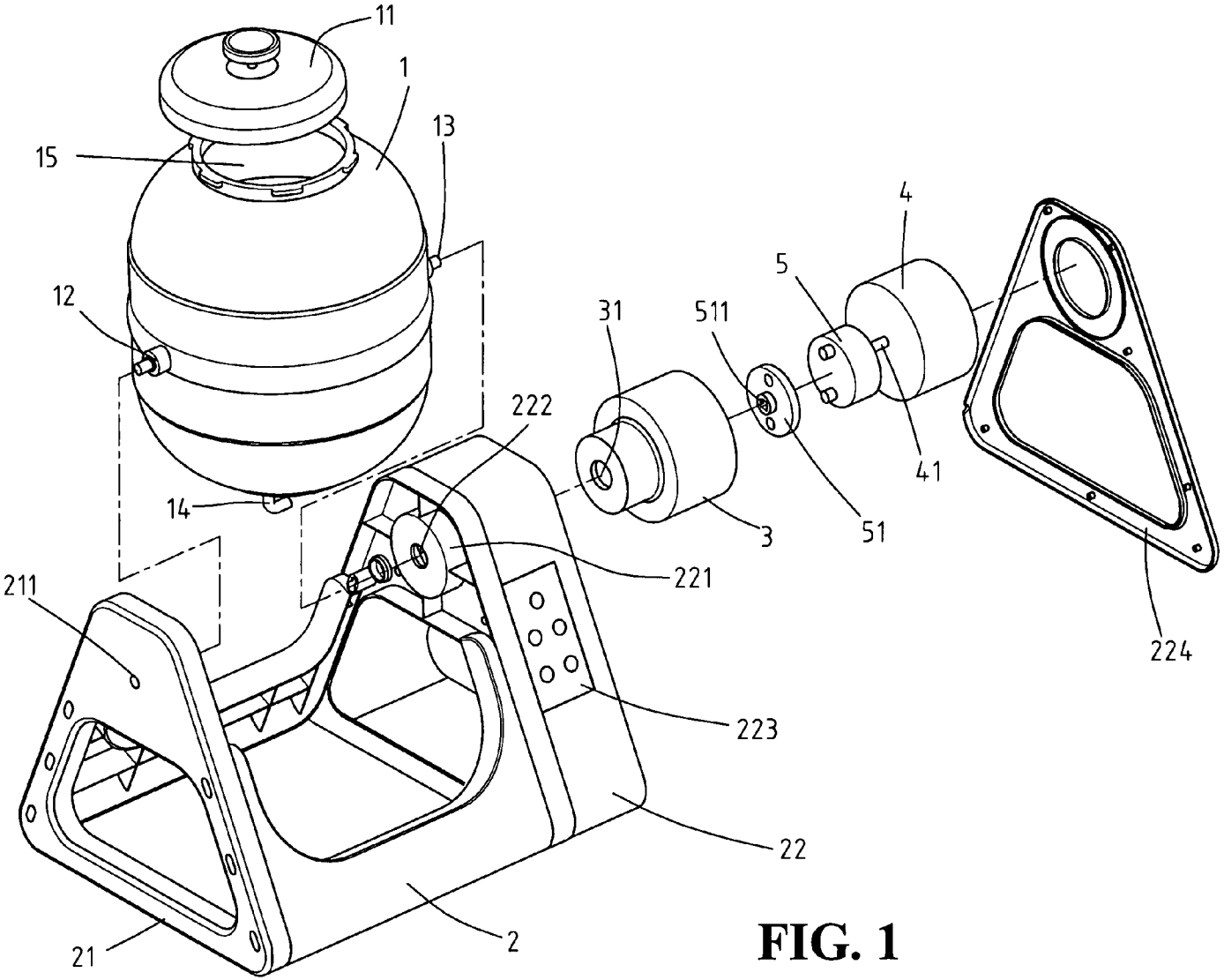
FIG. 1 is an exploded perspective view of a portable compact washing machine in accordance with the present invention.
Figure 2:
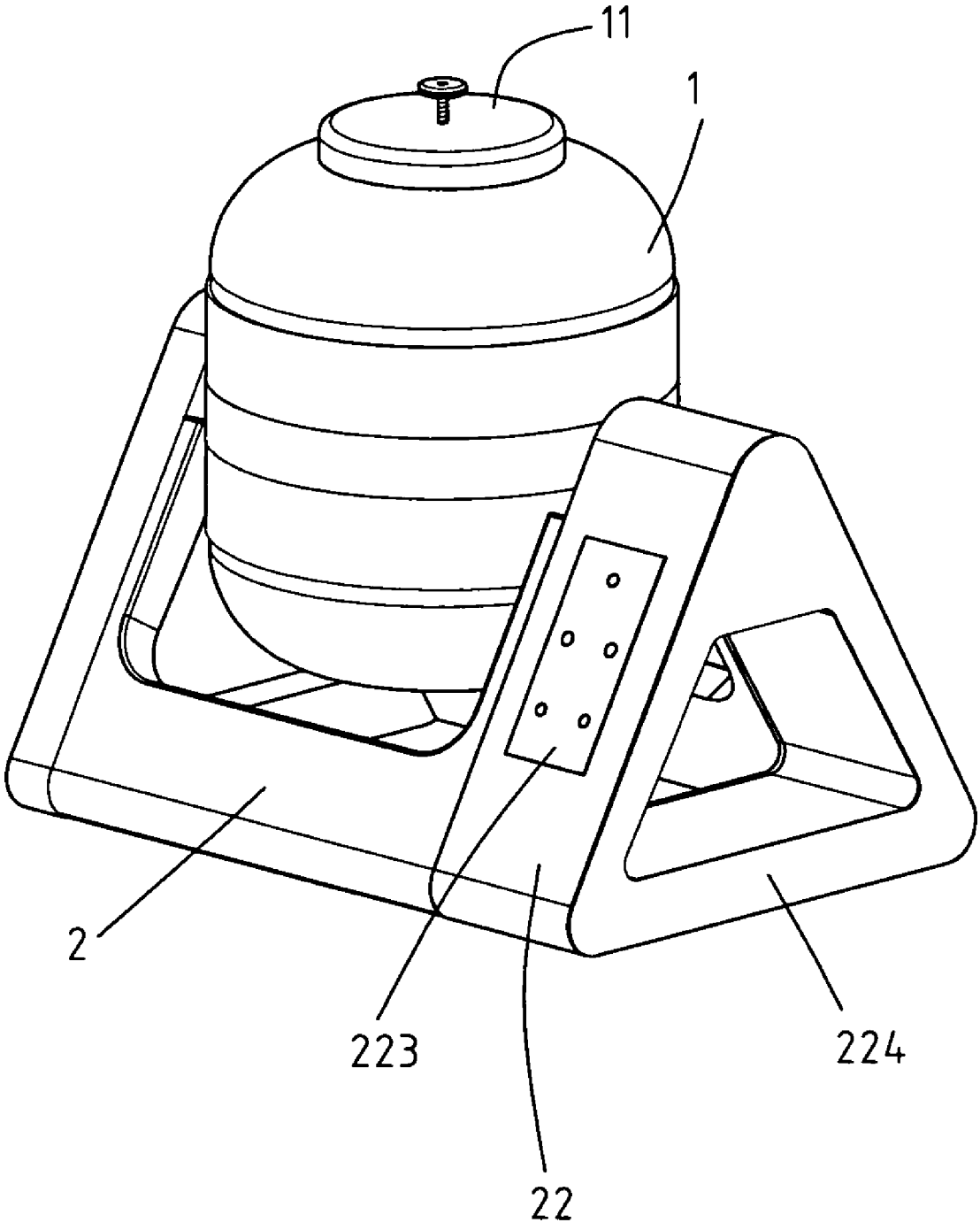
FIG. 2 is a perspective view of the portable compact washing machine in FIG. 1.
Figure 4:
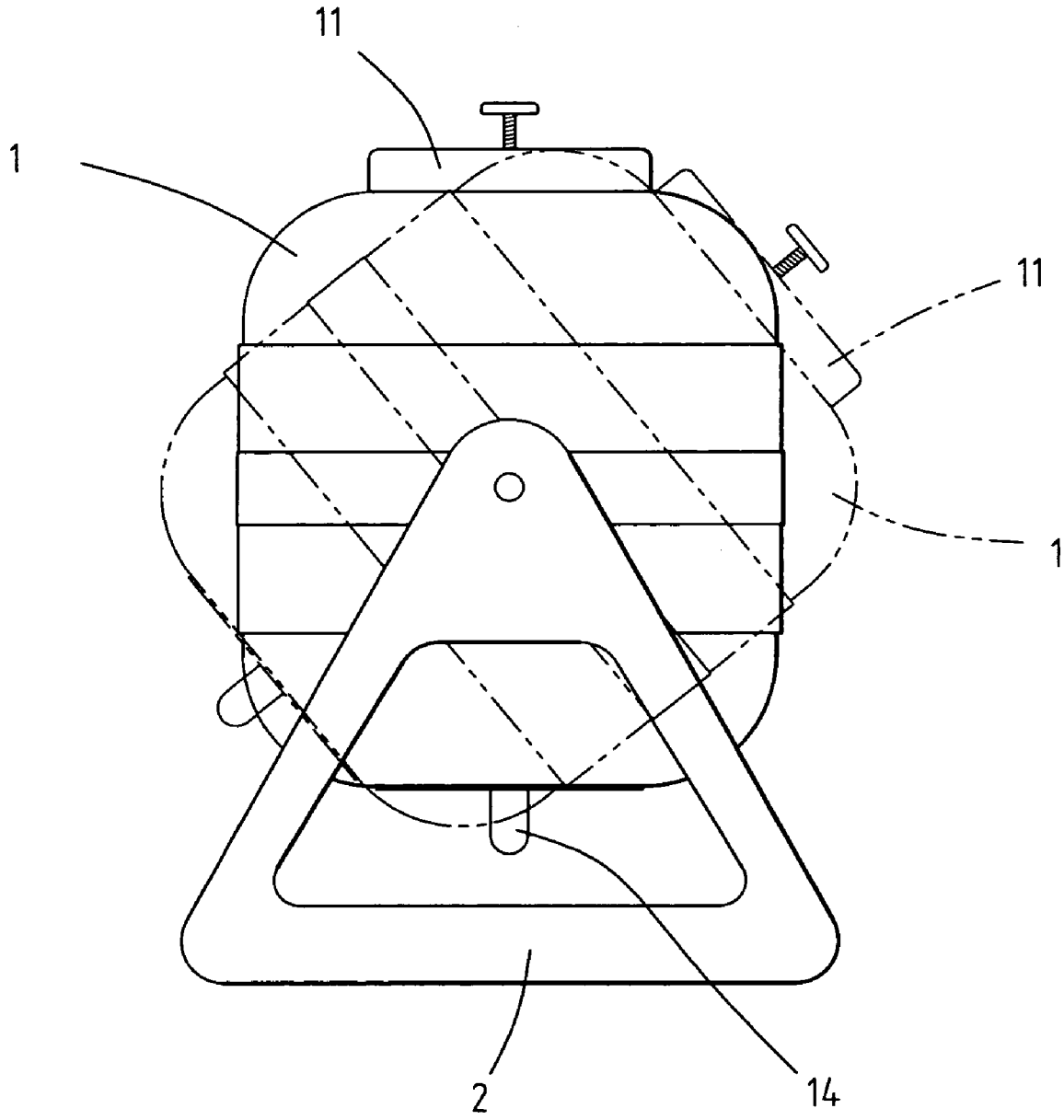
FIG. 4 is an operational side view of the portable compact washing machine in FIG. 2.

With reference to FIGS. 1, 2 and 4, a portable compact washing machine comprises a base (2), a drum (1), a motor housing (3), a motor (4) and a decelerator (5). The base (2) is a hollow prism and has a top, a front surface, a fixed end (21), a drive end (22) and a drum recess. The fixed end (21) has a first pin hole (211). The drive end (22) has a front surface, an outer surface, a longitudinal recess, a bushing recess (221), a second pin hole (222), a control panel (223) and an end cover (224). The longitudinal recess is formed in the outer surface of the drive end (22). The bushing recess (221) is formed in the longitudinal recess. The second pin hole (222) is formed through the bushing recess (221) and corresponds to and aligns with the first pin hole (211). The control panel (223) is mounted on the front surface of the drive end (22). The end cover (224) is mounted detachably on the drive end (22) and covers the longitudinal recess.

The drum recess is formed in the top of the base (2) between the fixed end (21) and the drive end (22). The drum (1) is mounted rotatably in the drum recess on the base (2), selectively holds water, detergent and clothing and linens and has a top end, a bottom end, an outer surface, an opening (115), a cap (11), two agitator pins (12, 13) and a drain (114). The opening (115) is formed in the top end. The cap (11) is mounted detachably on the opening (115), provides a watertight seal and holds clothing and linens in the drum (1). The agitator pins (12, 13) are formed on and protrude radially out from the outer surface of the drum (1) opposite to each other. One agitator pin (12) corresponds to and is mounted rotatably in the first pin hole (211). The other agitator pin (13) corresponds to and is mounted rotatably in the second pin hole (222). The drain (114) is formed at the bottom end.

Figure 3:
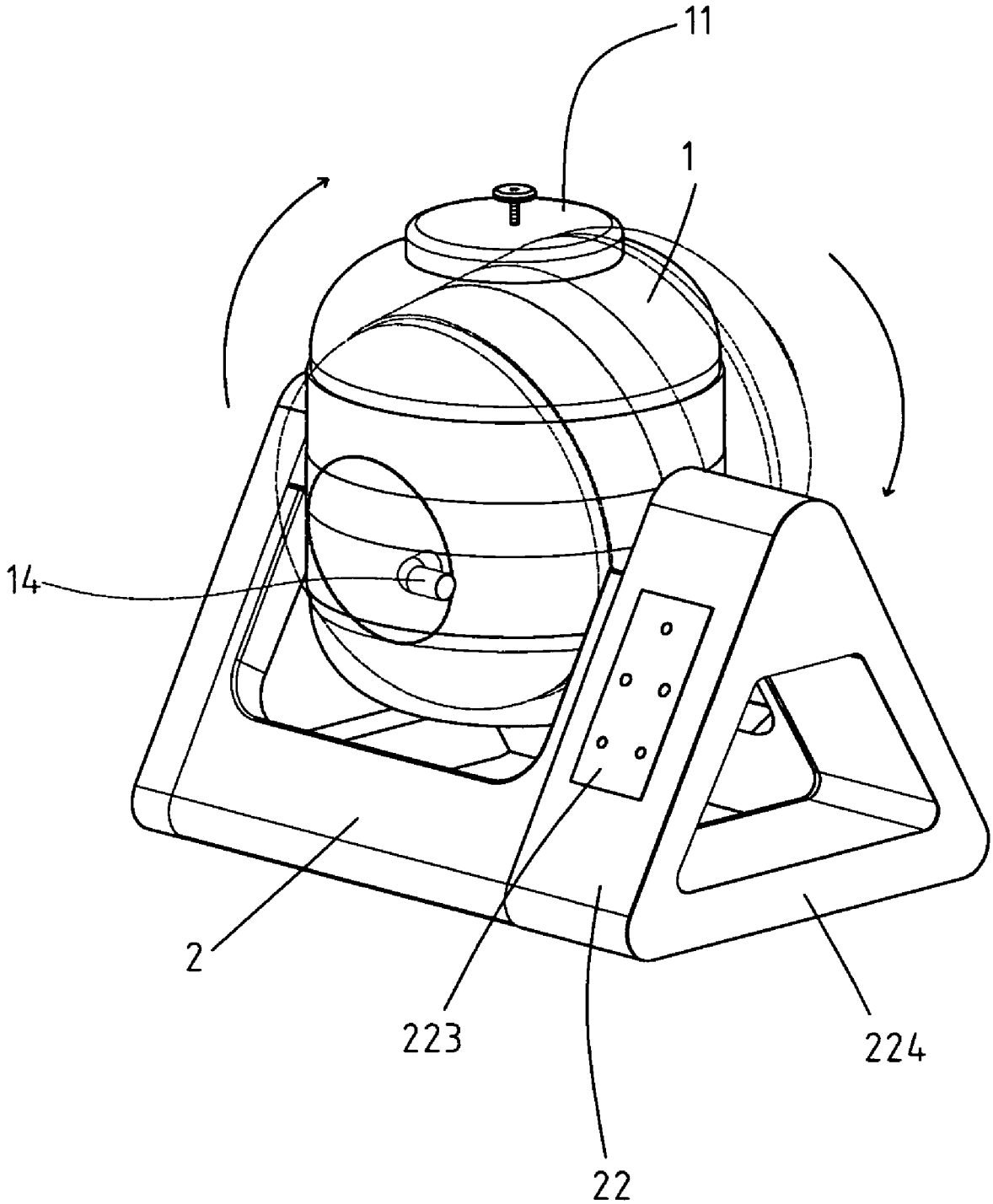
FIG. 3 is an operational perspective view of the portable compact washing machine in FIG. 2.

With further reference to FIG. 3, the motor housing (3) is hollow and has an internal cavity, an inner end, an outer end, two openings and a bushing. The openings are formed respectively at the inner end and outer end. The bushing is mounted at the inner end of the motor housing (3) and has a central through hole (31). The central through hole (31) communicates with the internal cavity of the motor housing (3) and aligns with the second pin hole (222).

The motor (4) is mounted in the motor housing (3), is connected electrically to and controlled by the control panel (223) and has a shaft (41).

The decelerator (5) may be jointed, is connected to the shaft (41) of the motor (4) to decelerate rotational speed of the shaft (41), is mounted in the bushing of the motor housing (3) and has an outer end, an inner end and a connector (51). The outer end is connected to the shaft (41). The inner end has two anchor pins. The connector (51) is mounted on the inner end and has two anchor holes and a connector hole (511). The two anchor holes correspond respectively to the two anchor pins and respectively hold the two anchor pins. The connector hole (511) corresponds to the through hole (31) and the second pin hole (222), holds the agitator pin (13) at the drive end (22) and connects to the decelerator (5) and the agitator pin (13) at the drive end (22).

What is claimed is:

1. A portable washing machine, comprising:

a base having a hollow prism, and including a top, a front surface, a fixed end having a first pin hole, a drive end including a front surface, an outer surface, a longitudinal recess formed in the outer surface of the drive end, a bushing recess formed in the longitudinal recess, a second pin hole formed through the bushing recess and corresponding to and aligning with the first pin hole, a control panel mounted on the front surface of the drive end, and an end cover detachably mounted on the drive end and covering the longitudinal recess, and a drum recess formed in the top of the base between the fixed end and the drive end;

a drum rotatably mounted in the drum recess on the base, selectively holding water, detergent and clothing and linens, and having a top end, a bottom end, an outer surface, an opening formed in the top end, a cap detachably mounted on the opening, the cap providing a watertight seal and holding clothing and linens in the drum, a first agitator pin and a second agitator pin formed on and protruding radially out from the outer surface of the drum opposite to each other, the first agitator pin corresponding to and being rotatably mounted in the first pin hole, and the second agitator pin corresponding to and being rotatably mounted in the second pin hole, and a drain formed at the bottom end;

a hollow motor housing, including an internal cavity, an inner end, an outer end, two openings formed respectively at the inner end and outer end; and a bushing mounted at the inner end of the motor housing and having a central through hole that communicates with the internal cavity of the motor housing and aligns with the second pin hole;

a motor mounted in the motor housing, the motor being electrically connected to and controlled by the control panel and having a shaft; and a decelerator connected to the shaft of the motor to decelerate a rotational speed of the shaft, the decelerator being mounted in the bushing of the motor housing, and including an outer end connected to the shaft, an inner end having two anchor pin, and a connector mounted on the inner end and having two anchor holes corresponding respectively to the two anchor pins and respectively holding the two anchor pins, the connector further having a connector hole corresponding to the through hole and the second pin hole, holding the agitator pin at the drive end and connecting to the decelerator and the agitator pin at the drive end.

2. The portable compact washing machine as claimed in claim 1, wherein the decelerator is jointed.

* * * * *